US005782287A

United States Patent [19]

Iwamoto et al.

[11] Patent Number: 5,782,287

[45] Date of Patent: *Jul. 21, 1998

[54] METHOD OF CONTROLLING VACUUM IN VACUUM DIE-CASTING AND VACUUM CONTROL SYSTEM FOR CARRYING OUT THE SAME

[75] Inventors: Norihiro Iwamoto, Sagamihara; Shinobu Kodama, Zama, both of Japan

[73] Assignee: Toshiba Kikai Kabushiki Kaisha, Tokyo-To, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 659,913

[22] Filed: Jun. 7, 1996

[30] Foreign Application Priority Data

Jun. 8, 1995 [JP] Japan ..... 7-142019

[51] Int. Cl.[6] ..... B22D 17/32

[52] U.S. Cl. ..... 164/155.3; 164/305; 164/312

[58] Field of Search ..... 164/155.3, 157, 164/305, 312, 457, 113, 155.4, 61, 65

[56] References Cited

U.S. PATENT DOCUMENTS 5,022,457 6/1991 Iwamoto et al. ..... 164/155.3
5,511,605 4/1996 Iwamoto ..... 164/155.3

FOREIGN PATENT DOCUMENTS 2-205243 8/1990 Japan ..... 164/305
2-220756 9/1990 Japan ..... 164/305

*Primary Examiner*—Kuang Y. Lin
*Attorney, Agent, or Firm*—Cushman Darby & Cushman Intellectual Property Group of Pillsbury Madison & Sutro LLP

[57] ABSTRACT

A method of controlling vacuum in vacuum die-casting and a vacuum control system for performing the same adjusts the time to open a vacuum valve to start degassing in connection with the position of an injection plunger to control vacuum in a cavity so that gases may not be involved in a molten metal injected into the cavity. The method comprises opening the vacuum valve to start degassing the cavity upon the advancement of the injection plunger to a first position. The vacuum in a vacuum system is measured upon the arrival of the injection plunger at a second position immediately before a final position where the injection plunger completes the injection of the molten metal. A measured vacuum is compared with a predetermined reference vacuum. The first position is shifted by a predetermined distance toward the die when the measured vacuum is higher than the reference vacuum or by a predetermined distance away from the die when the measured vacuum is lower than the reference vacuum to set a corrected first position. The vacuum valve is opened when the injection plunger arrives at the corrected first position in the next injection cycle.

7 Claims, 7 Drawing Sheets

METHOD OF CONTROLLING VACUUM IN VACUUM DIE-CASTING AND VACUUM CONTROL SYSTEM FOR CARRYING OUT THE SAME

BACKGROUND OF THE INVENTION

1. Field of the Invention

The present invention relates to a method of controlling a vacuum in vacuum die-casting to stabilize the quality of castings by preventing the formation of blowholes due to involvement of gases in a molten metal when injecting the molten metal into a cavity of a die through the control of the cavity at vacuums within prescribed limits.

2. Description of the Related Art

A known vacuum control system for a conventional vacuum die-casting machine has a die that includes a fixed die and a movable die joined together to form a cavity. The cavity is connected by way of a vacuum line provided with a vacuum valve to a vacuum device. The vacuum device includes a vacuum tank and a vacuum pump. The vacuum tank is evacuated to and maintained at a high vacuum by the vacuum pump. Therefore, the cavity is evacuated in an instant when the vacuum valve is opened. A filter and a vacuum gauge are placed in the vacuum line at positions on the downstream side of the vacuum valve.

An injection sleeve for forcing molten metal under pressure into the cavity is provided with a sprue at a predetermined position. An injection plunger for pressing the molten metal is slidably fitted in the injection sleeve. An injection ram joined to the injection plunger is connected to an injection cylinder actuator for applying pressure to the molten metal. A dog is mounted on the injection ram so that the dog comes into contact with the actuators of a first limit switch and a second limit switch at predetermined positions to time the opening and closing operations of the vacuum valve in connection with the operation of the injection plunger. The limit switches are connected to a relay for controlling the vacuum valve for opening and closing operations.

The injection plunger is advanced from its initial position to a first position where the sprue is closed by the injection plunger after the molten metal is poured through the sprue into the injection sleeve from a ladle. When this advancement occurs, the dog strikes the actuator of the first limit switch to close the first limit switch, whereby a contact of the relay is closed, a solenoid of the vacuum valve is energized and the vacuum valve opens. Consequently, the cavity communicates through the vacuum valve with the vacuum tank and is evacuated rapidly to a vacuum. Thus the molten metal is caused to start flowing into the cavity by the cooperative action of the vacuum in the cavity and the advancement of the injection plunger. The injection plunger advances further and upon the arrival of the injection plunger at a second position, the dog strikes the actuator of the second limit switch, whereby the contact of the relay is opened. Consequently, the vacuum valve is closed immediately before pouring the molten metal into the cavity is completed. Thus, the sufficiently evacuated cavity is charged rapidly with the molten metal.

In this conventional vacuum die-casting machine, however, the timing of the vacuum valve for opening and closing operations is achieved only by the positional relation between the first and second limit switches and the dog and is independent of the control of vacuum. Therefore, it is possible that gases are sucked into the cavity together with the molten metal. If the vacuum valve opens before the injection plunger arrives at the sprue or when the surface of the molten metal poured into the injection sleeve is below the level of the center axis of the injection sleeve, the molten metal is sucked into the cavity involving gases. Such a phenomenon is a cause of the deterioration of the quality of castings by blowholes.

Since the time necessary for the injection plunger to complete a high-speed injection stroke is very short and is not very different from a delay in the operation of the vacuum valve, i.e., a solenoid valve, it has been very difficult to time the opening and closing operation of the vacuum valve properly. A die-casting machine controller disclosed in U.S. Pat. No. 5,022,457 provides a technique of timing the operation of the vacuum valve.

Vacuum control and the operation timing of the vacuum valve to prevent of blowholes is important to stabilize the quality of the castings. It is known that filling a cavity with a molten metal while the cavity is maintained at a fixed vacuum is effective in preventing blowholes. However, it has been difficult to maintain a fixed vacuum through a feedback control responsive to measured vacuum because the quantity of the molten metal is not always constant, the control of vacuum is affected by the combined effect of various factors including the variable quantity of the molten metal and errors introduced into measured vacuum by a vacuum sensor, and the injection cycle time is as short as several seconds. Accordingly, it has been an ordinary practice to control the vacuum on the basis of data obtained by visually reading an indication on the vacuum gauge.

SUMMARY OF THE INVENTION

The present invention solves the foregoing problems in the prior art. It is, therefore, an object of the present invention to obtain castings of a high quality having no blowholes by properly timing the operation of a vacuum valve in connection with the position of a plunger for forcing a molten metal under pressure into a cavity to control vacuum in the cavity so that the involvement of air in a molten metal can be prevented when injecting the molten metal into the cavity.

With the view of foregoing object, the present invention provides a method of controlling vacuum for vacuum die-casting comprising injecting a molten metal into a cavity formed in a die by an injection plunger, opening a vacuum valve included in a vacuum system connected to the cavity to suck the molten metal into the cavity and applying pressure to the molten metal injected into the cavity. The method comprises opening the vacuum valve to start degassing the cavity upon the advancement of the injection plunger to a first position, the vacuum in the vacuum system is measured upon the arrival of the injection plunger at a second position immediately before a final position where the injection plunger completes the injection of the molten metal. A measured vacuum is compared with a predetermined reference vacuum, shifting the first position by a predetermined distance toward the die when the measured vacuum is higher than the reference vacuum or by a predetermined distance away from the die when the measured vacuum is lower than the reference vacuum to set a corrected first position. The vacuum valve is opened when the injection plunger arrives at the corrected first position in the next injection cycle.

The second position and the final position of the injection plunger are determined beforehand, and the measurement of vacuum is started upon the start of an injection cycle. Vacuum is measured for specific periods and plotted on a time axis to obtain data on vacuum. A measured vacuum, when the injection plunger is at the second position, is compared with the reference vacuum. The difference between the measured vacuum and the reference vacuum is converted into time on the basis of the vacuum data. The time is converted into a correction for correcting the position of the injection plunger. The correction is added to the first position to determine a corrected first position of the injection plunger for the next injection cycle.

A vacuum control system in accordance with the present invention for use in combination with a vacuum die-casting machine has a vacuum system connected to a cavity formed in a die. A vacuum valve connects the vacuum system to and disconnects the same from the cavity. A vacuum device evacuates the cavity through the vacuum system and an injection plunger for injects a molten metal into the cavity. The vacuum device comprises a vacuum measuring means for measuring vacuum in the vacuum system and a position detecting means for detecting the position of the injection plunger. A data storage means stores data on vacuum taken at a predetermined period after the start of an injection cycle. A vacuum comparing means compares a vacuum measured immediately before the completion of the injection of the molten metal into the cavity and a predetermined reference vacuum. A vacuum valve opening position correcting means corrects a first position at which to open the vacuum valve so that the first position is shifted by a predetermined distance toward the die when the measured vacuum is higher than the reference vacuum. Alternatively, the first position is shifted by a predetermined distance away from the die when the measured vacuum is lower than the reference vacuum.

In this vacuum control system, an air vent means may be provided which is a chilling vent for passing only gases. The air vent may also have a corrugated degassing passage that solidifies the head of the molten metal so that the molten metal is unable to flow into the vacuum system or a shutoff valve that passes only gasses by using the inertia of the molten metal injected into the cavity.

Preferably, the vacuum detecting means comprises a vacuum sensor, and a check valve connected in parallel to the vacuum sensor.

The vacuum control system may be provided with an alarm signal generating means for generating an alarm signal or a die-casting machine stopping signal when the measured vacuum is lower than a predetermined limit vacuum. An alarm device generates an alarm upon the reception of an alarm signal.

The vacuum control system may be provided with a data processing means for processing the data on vacuum stored in the storage means and data provided by the position detecting means. The vacuum control system calculates the variation of vacuum with time and parameters indicating the speed of the injection plunger and the condition of the injection cycle. A monitor displays a vacuum variation curve indicating the variation of vacuum with time representing the output of the data processing means, an injection speed curve indicating the variation of the speed of the injection plunger with time, and the parameters.

When the injection plunger is advanced to the first position, a degassing operation is started. Vacuum is measured upon the arrival of the injection plunger at the second position immediately before the final position where the injection plunger completes the injection of the molten metal. The first position at which to open the vacuum valve is shifted forward by a predetermined distance when the measured vacuum is higher than the reference vacuum. Consequently, the time when the vacuum valve opens to reduce the pressure of the cavity in the next injection cycle is delayed. Thus the vacuum coincide with a fixed vacuum immediately before the completion of injection of the molten metal.

When the vacuum is low due to some cause, such as blinding of a filter, the position where the injection plunger causes the vacuum valve to open is shifted backward with respect to the direction of advancement of the injection plunger for injecting the molten metal. Therefore, the vacuum valve opens at an earlier time point to start the evacuation of the cavity at an earlier time point in the next injection cycle. Consequently, the vacuum in the cavity can be automatically kept within prescribed limits.

When the vacuum in the cavity is considerably lower than the reference vacuum, an alarm is provided automatically. The condition of the injection cycle can be monitored in a real-time mode using the vacuum variation curve and the injection speed curve displayed on the monitor.

DETAILED DESCRIPTION OF THE INVENTION

Figure 7:
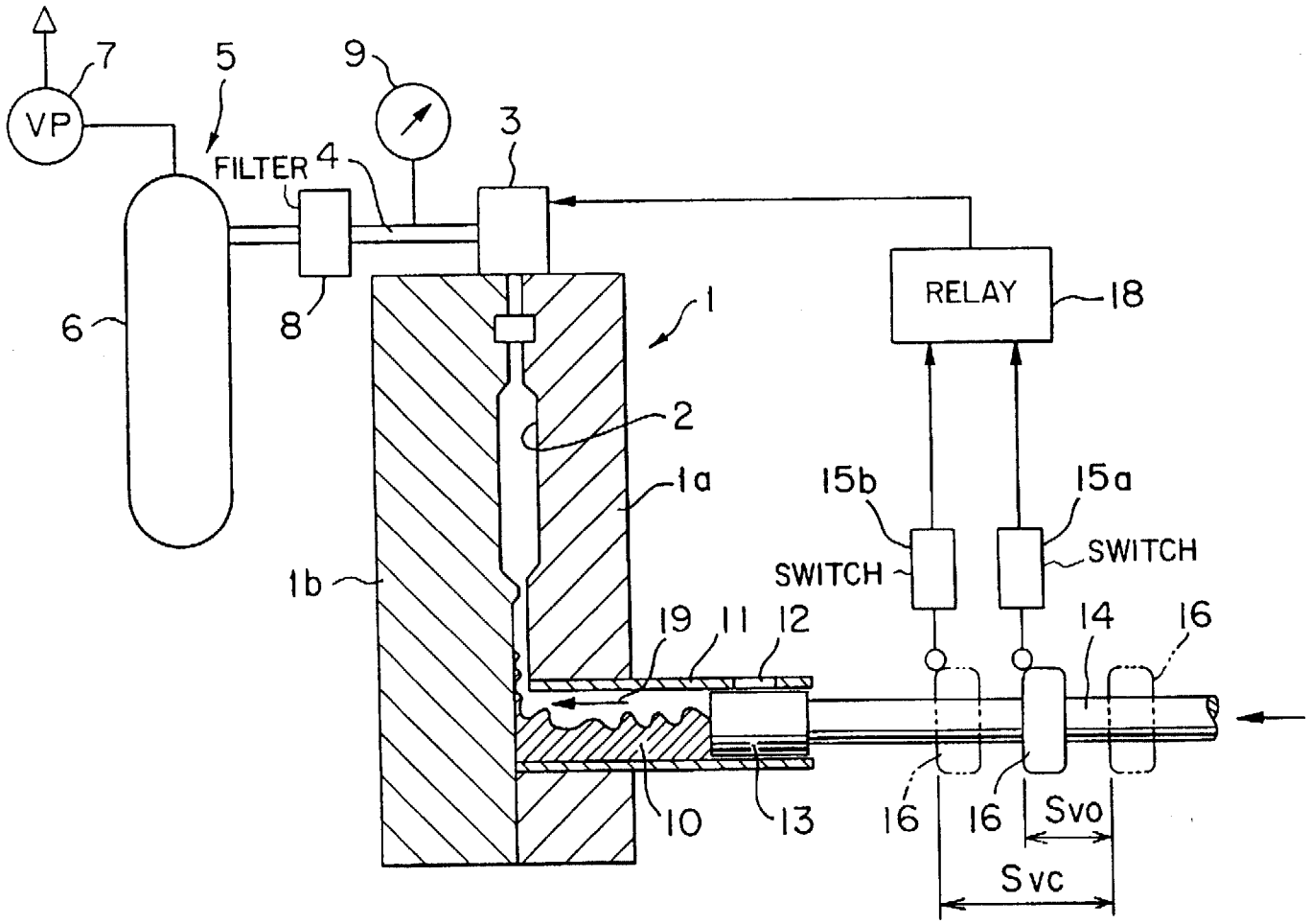
FIG. 7 PRIOR ART
FIG. 7 is a diagrammatic view showing the configuration of a conventional vacuum control system.

In order for the present invention to be understood in comparison with the underlying problems of the known art described above, a known vacuum control system will be described below with reference to FIG. 7.

The vacuum control system shown has a die consisting of a fixed die 1*a* and a movable die 1*b* joined together to form a cavity 2. The cavity 2 is connected by a vacuum line 4 provided with a vacuum valve 3 to a vacuum device 5. The vacuum device 5 includes a vacuum tank 6 and a vacuum pump 7. The vacuum tank 6 is evacuated to and maintained at a high vacuum by the vacuum pump 7. Therefore, the cavity 2 evacuated in an instant when the vacuum valve 3 is opened. A filter 8 and a vacuum gauge 9 are placed in the vacuum line at positions on the downstream side of the vacuum valve 3, respectively. The vacuum gauge 9 indicates vacuum in the vacuum system for monitoring the vacuum.

An injection sleeve 11 for forcing molten metal 10 under pressure into the cavity 2 is provided with a sprue 12 at a predetermined position, and an injection plunger 13 for pressing the molten metal 10 is slidably fitted in the injection sleeve 11. An injection ram 14 joined to the injection plunger 13 is connected to an injection cylinder actuator, not shown, for applying pressure to the molten metal 10. A dog 16 is mounted on the injection ram 14 so that the dog 16 comes into contact with the actuators of a first limit switch 15*a* and a second limit switch 15*b* at predetermined positions to time the opening and closing operations of the vacuum valve 3 in connection with the operation of the injection plunger 13. The limit switches 15*a* and 15*b* are connected to a relay 18 for controlling the vacuum valve 3 for opening and closing operations.

The injection plunger 13 is advanced by a distance $S_{vo}$ from its initial position to a first position where the sprue 12 is closed by the injection plunger 13 after the molten metal is poured through the sprue 12 into the injection sleeve 11 from a ladle, (not shown); When this advancement occurs, the dog 16 strikes the actuator of the first limit switch 15*a* to close the first limit switch 15*a*, whereby a contact of the relay 18 is closed, a solenoid, not shown, of the vacuum valve 3 is energized and the vacuum valve 3 opens. Consequently, the cavity 2 communicates through the vacuum valve 3 with the vacuum tank 6 and is evacuated rapidly to a vacuum. Thus the molten metal 10 is caused to start flowing into the cavity 2 by the cooperative action of the vacuum in the cavity 2 and the advancement of the injection plunger 13. The injection plunger 13 advances further and upon the arrival of the injection plunger 13 at a second position after traveling an injection stroke $S_{vc\%}$. When this further advancement occurs, the dog 16 strikes the actuator of the second limit switch 15*b*, whereby the contact of the relay 18 is opened. Consequently, the vacuum valve 3 is closed immediately before the completion of pouring the molten metal 10 into the cavity 2. Thus the sufficiently evacuated cavity 2 is charged rapidly with the molten metal 10.

In this conventional vacuum die-casting machine, however, the timing of the vacuum valve 3 for opening and closing operations is achieved only by the positional relation between the limit switches 15*a* and 15*b* and the dog 16 and is independent of the control of vacuum. Therefore, it is possible that gases are sucked into the cavity 2 together with the molten metal 10. If the vacuum valve 3 opens before the injection plunger 13 arrives at the sprue 12 or when the surface of the molten metal 10 poured into the injection sleeve 11 is below the level of the center axis of the injection sleeve 11, the molten metal 10 is sucked into the cavity 2 involving gases. Such a phenomenon is a cause of the deterioration of the quality of castings by blowholes.

Since the time necessary for the injection plunger 13 to complete a high-speed injection stroke is very short and is not very different from a delay in the operation of the vacuum valve 3, i.e., a solenoid valve, it has been very difficult to time the opening and closing operation of the vacuum valve properly.

The control of vacuum and the timing of operation of the vacuum valve is important to prevent blowholes to stabilize the quality of castings. It is known that filling a cavity with a molten metal while the cavity is maintained at a fixed vacuum is effective in preventing blowholes. However, it has been difficult to maintain a fixed vacuum through feedback control responsive to measured vacuum. The difficulty arises quantity of the molten metal is not always constant, the control of vacuum is affected by combined the effect of various factors including the variable quantity of the molten metal and errors introduced into measured vacuum by a vacuum sensor, and the injection cycle time is as short as several seconds. Accordingly, it has been an ordinary practice to control vacuum on the basis of data obtained by visually reading an indication on the vacuum gauge.

Figure 1:
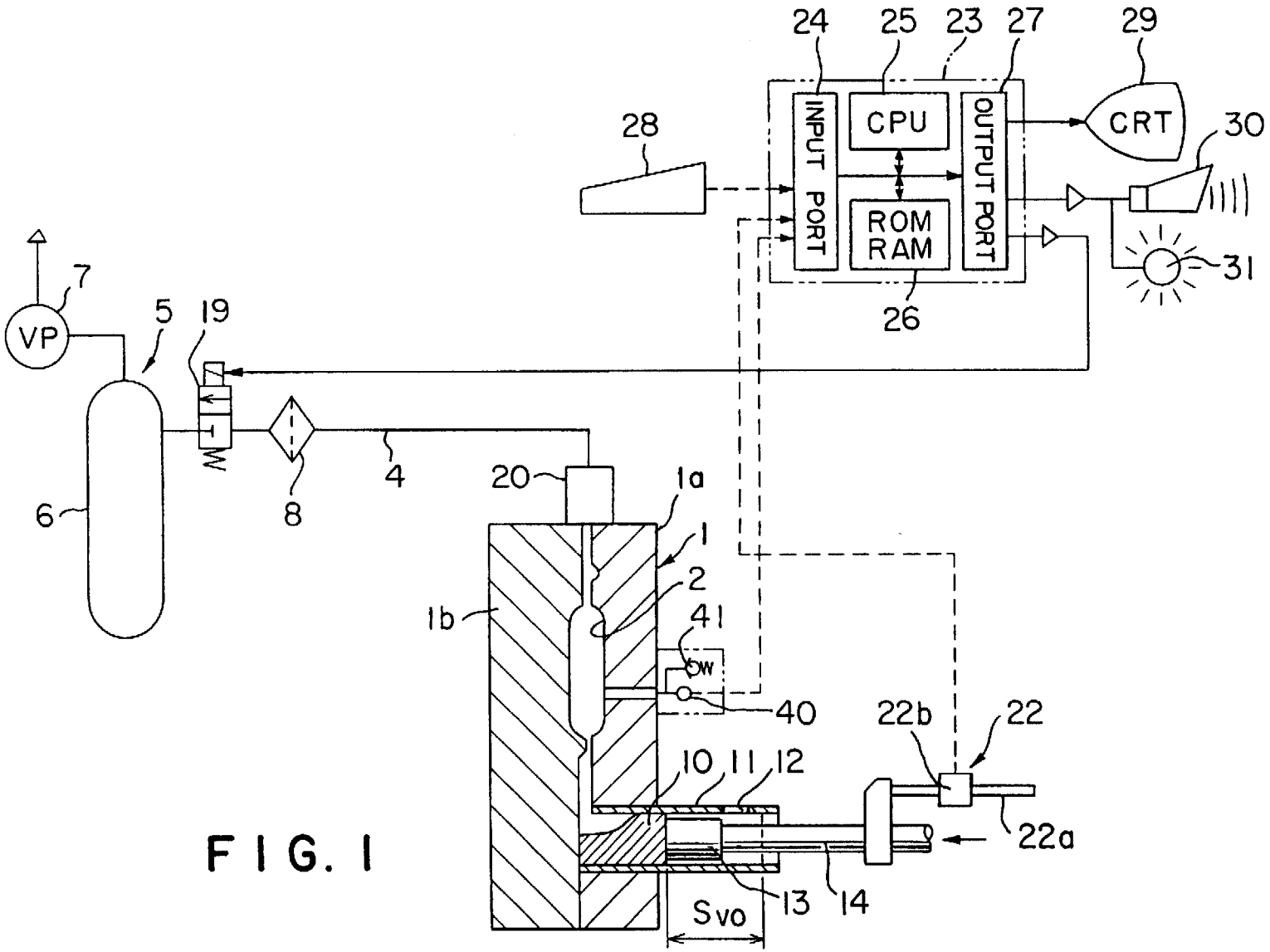
FIG. 1 is a diagrammatic view showing the configuration of a vacuum control system in a preferred embodiment according to the present invention.

A method of controlling vacuum in vacuum die-casting in a preferred embodiment according to the present invention and a vacuum control system in a preferred embodiment according to the present invention for carrying out the foregoing method will now be described with reference to the accompanying drawings. FIG. 1 shows the configuration of a vacuum control system in a preferred embodiment according to the present invention, wherein components like or corresponding to those shown in FIG. 7 are designated by the same reference characters and the description thereof will be omitted.

FIG. 1 shows a vacuum control system embodying the present invention. A vacuum line 4 connecting a cavity 2 formed in a die 1 to a vacuum tank 6 is provided with a filter 8 and a vacuum solenoid valve 19. The vacuum solenoid valve 19 is opened for degassing. This embodiment employs a well-known type of chilling vent 20 generally used in die-casting as an air vent means for degassing the cavity 2 when the solenoid vacuum valve 19 is opened. The chilling vent 20 is attached to the die 1 and the vacuum line 4 communicates with the cavity 2 by means of the chilling vent 20.

Figure 2:
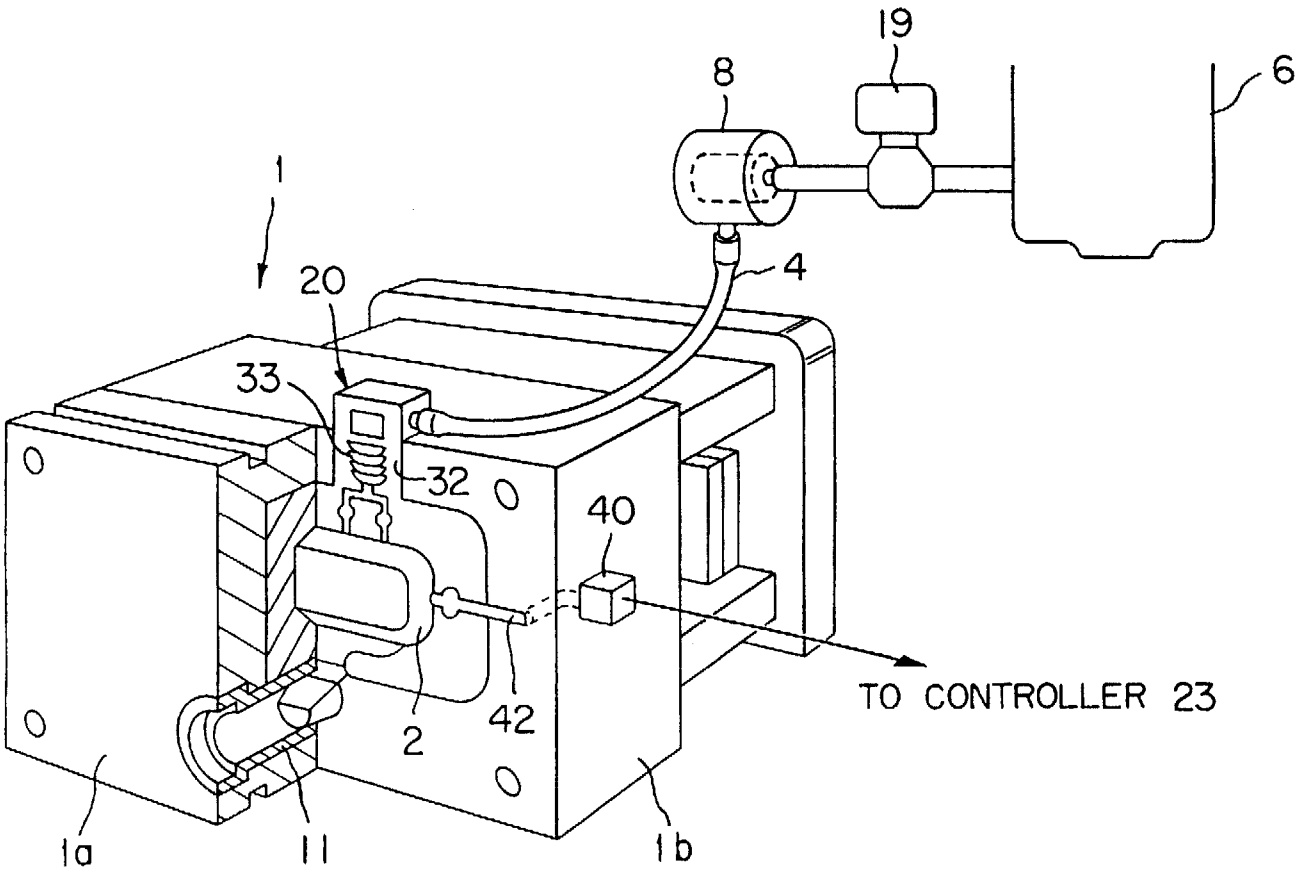
FIG. 2 is a perspective view of a vacuum controller used in the present invention employing a chilling vent as a degassing means.

As shown in FIG. 2, the chilling vent 20 has a body 32 fitted in the movable die 1*b* of the die 1 and provided with a corrugated vent passage 33. The corrugated vent passage 33 communicates with the cavity 2 by way of runners. When a vacuum is produced in the cavity 2, gases staying in the cavity are sucked through the corrugated vent passage 33 into the vacuum line 4, while a molten metal filling up the cavity 2 and sucked up to the corrugated vent passage 33 is chilled and solidifies to stop up the corrugated vent passage 33. Thus, only gases are evacuated from the cavity 2 through the corrugated passage 33.

Figure 3:
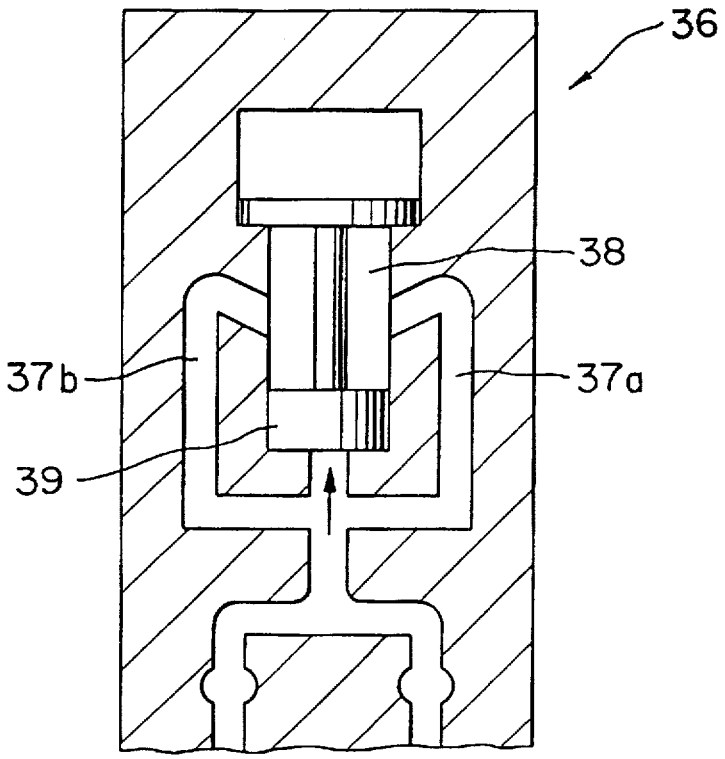
FIG. 3 is a schematic sectional view of a metal shutoff valve to be employed as a degassing means.

A metal shutoff valve 36 shown in FIG. 3 may be employed instead of the chilling vent 20 as the air vent means. The metal shutoff valve 36 has a vent chamber 38, a spool 39 fitted in the vent chamber 38, and vent passages 37*a* and 37*b*. The spool 39 is moved up, as viewed in FIG. 3, by the inertial force of the molten metal to vent only gases. The joint of the runners connected to the cavity 2 is connected to the vent passages 37*a* and 37*b* having outlet ends opening into the vent chamber 38. The spool 39 is raised by the upward inertial force of the molten metal and closes the outlet ends of the vent passages 37*a* and 37*b*. Thus, only gasses are able to flow through the vent passages 37*a* and 37*b*.

As shown in FIG. 1, a vacuum sensor 40, i.e., a vacuum detecting means, and a check valve 41 are connected to a port 42 (FIG. 2) formed in the die 1 so as to open into the cavity 2. When the molten metal poured into the cavity 2 is pressurized by the injection plunger 13 and a positive pressure exceeding a predetermined level acts on the vacuum sensor 40, the check valve 41 opens to prevent damage to the vacuum sensor 40.

A position detecting means 22 detects the position of the injection plunger 13 and includes a magnetic scale 22*a* attached to a ram 14 joined to the injection plunger 13. A displacement gauge or sensor 22*b* measures the displacement of the magnetic scale 22*a*. The displacement sensor 22*b* provides a pulse signal proportional to the displacement of the injection plunger 13. The output signals of the vacuum sensor 40 and the displacement sensor 22*b* are given to a controller 23. The controller 23 has a central processing unit 25 including a microprocessor, a main storage unit 26 including a ROM, and a RAM for storing input data and processed data, an input port 24, and an output port 27. The central processing unit 25 is connected through the input port 24 to the vacuum sensor 40, the displacement sensor 22*b*, and a keyboard 28, i.e., an input device, for entering set data necessary for vacuum control. Output devices including a CRT 29 for displaying curves and the like indicating information of the operating state, an alarm device 30 and an alarm lamp 31, and the vacuum valve 19 are connected to the output port 27.

Figure 4:
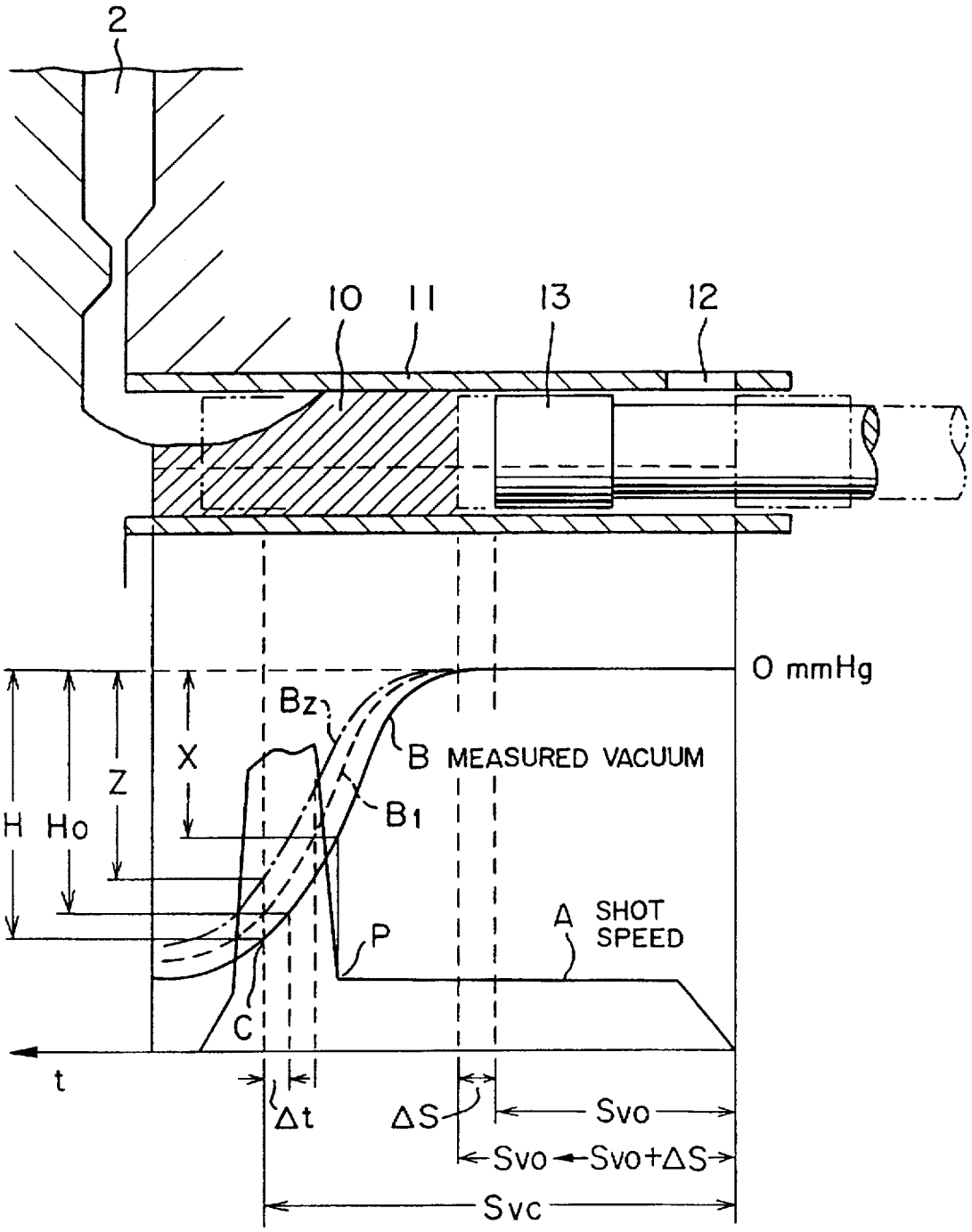
FIG. 4 is a diagrammatic view showing the display of a monitor displaying a vacuum variation curve and an injection speed curve during an injection cycle under a condition where vacuum is higher than a reference vacuum.

The operation of the embodiment will be described below in connection with an injection process. FIG. 4 is a time chart showing vacuum and shot speed corresponding to the position of the the injection plunger 13. In FIG. 4, a curve A indicates the shot speed, i.e., the moving speed of the injection plunger 13, and a curve B indicates the variation of measured vacuum. A vacuum of 0 corresponds to the atmospheric pressure, and higher vacuums are plotted at lower positions below a line corresponding to the atmospheric pressure. The injection plunger 13 moves in a first stroke to a first position indicated at $S_{vo}$ and moves in a second stroke to a second position indicated at $S_{vc}$. Upon the arrival of the injection plunger 13 at the first position, a signal to open the vacuum valve 19 is provided. The second position is immediately before a final position where the injection plunger 13 complete injection operation for filling up the cavity 2 with a molten metal. Set data including the strokes $S_{vo}$ and $S_{vc}$, and a reference vacuum $H_o$ are entered previously by operating the keyboard 28 to set initial conditions for a casting cycle of the die-casting machine.

Figure 6:
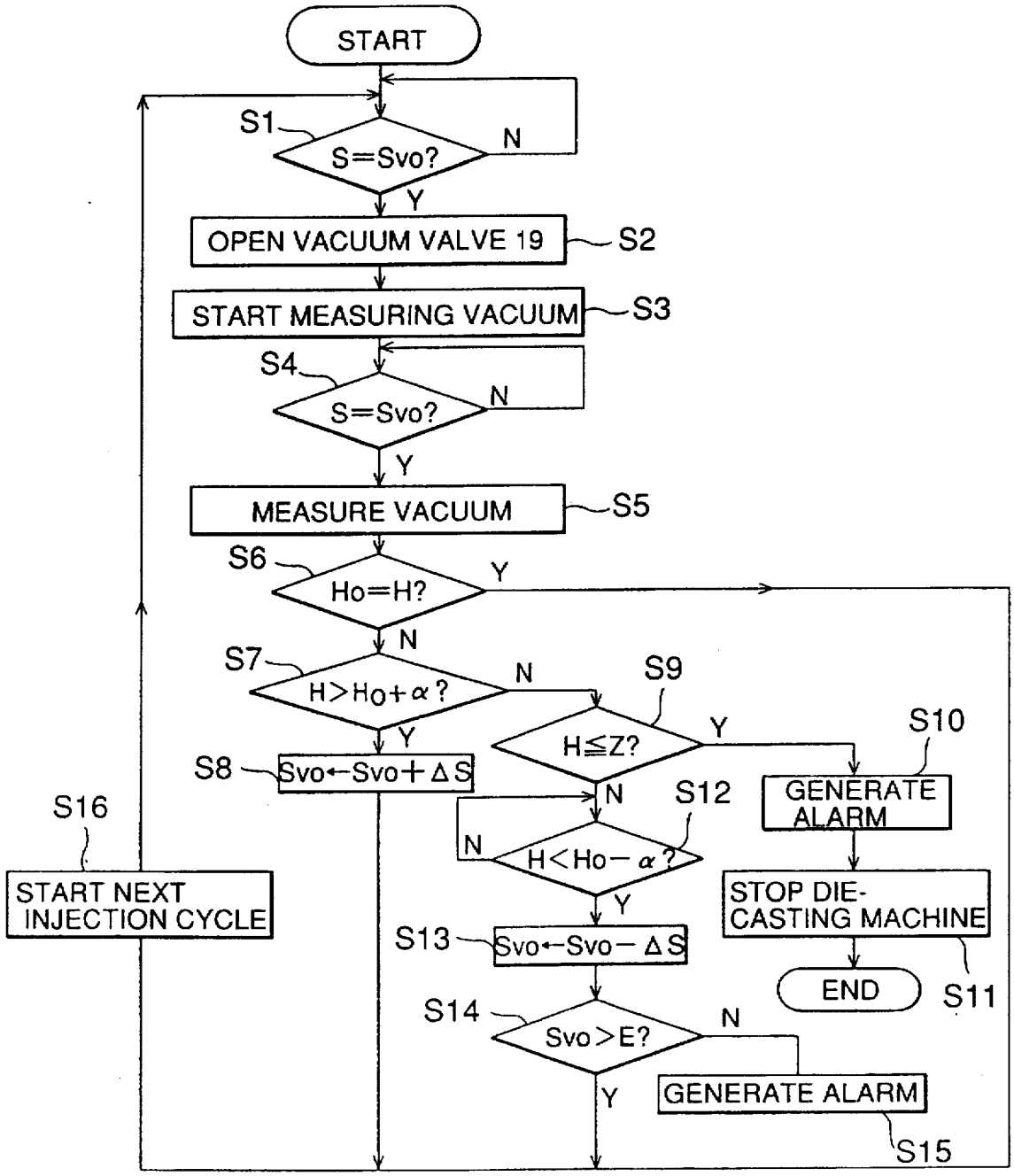
FIG. 6 is a flow chart of a vacuum control program to be carried out by the vacuum control system of the present invention.

The operation of the controller 23 will be described with reference to a flow chart shown in FIG. 6.

Upon the start of the casting cycle, a signal representing a position S of the injection plunger 13 measured by the displacement sensor 22*b* is given to the central processing unit 25. The injection plunger 13 advances through the first stroke $S_{vo}$ and the arrival of the injection plunger 13 at the first position is detected in step S1. The central processing unit 25 gives a signal for energizing the solenoid of the vacuum valve 19 to a driving circuit, not shown, to open the vacuum valve 19 in step S2. Consequently, the cavity 2 is connected to the vacuum tank 6 and the cavity 2 is degassed through the chilling vent 20. Subsequently, vacuum in the cavity 2 increases along the curve B and the cavity 2 is charged rapidly with the molten metal. Upon the start of degassing, determination of vacuum in the cavity 2 on the basis of the output of the vacuum sensor 40 is started in step S3. Data of vacuum obtained by measurement at a predetermined period are stored in the main storage unit 26 of the controller 23. The arrival of the injection plunger 13 at the second position after advancing through the second stroke $S_{vc}$ is detected in step S4. When this position is detected, a vacuum H at a point in time immediately before the completion of charging of the cavity 2 with the molten metal is measured in step S5 and the vacuum H is compared with the reference vacuum $H_o$.

A position correcting procedure for correcting the first stroke $S_{vo}$ of the injection plunger 13 relating to the time the vacuum valve 19 is opened according to the result of comparison is executed to determine a corrected first stroke for the next injection cycle. When the measured vacuum H is equal to the reference vacuum $H_o$ or within an allowable range of $H_o \pm \alpha$, i.e., when the decision in step S6 is affirmative, any correction is not made and the program returns through step S16 to step S1 to start the next injection cycle.

When the measured vacuum H is higher than the upper limit $H_o+\alpha$ of the allowable range as shown in FIG. 4, i.e., when the decision in step S7 is affirmative, a predetermined correction $\Delta S$ is added to the first stroke $S_{vo}$, by which the injection plunger 13 advances to reach the first position at which to open the vacuum valve 19. Thus, shift the first position toward the die 1 by the correction $\Delta S$ by increasing the first stroke $S_{vo}$ by the correction $\Delta S$ in order to delay the time to open the vacuum valve 19 in the next injection cycle. Thus, the injection plunger moves a stroke $S_{vo}+\Delta S$ to reach a corrected first position at which to open the vacuum valve 19 in the next injection cycle.

The first stroke $S_{vo}$, in which the injection plunger 13 advances to reach the first position, is corrected on the basis of the stored data representing the variation of vacuum with time as indicated by the curve B in FIG. 4. The mode of injection cycle is expressed by the diagram shown in FIG. 4 the vacuum H which illustrates that at the time the injection plunger 13 is at the second position immediately before the final position where injection is to be completed, is higher than the reference vacuum $H_o$. The difference between the vacuum H and the reference vacuum $H_o$ can be converted into a corresponding time difference $\Delta t$. Assume that the time difference $\Delta t$ corresponds to the correction $\Delta S$. Then, vacuum H is expected to vary with time along a curve $B_1$ in the next injection cycle when the first stroke $S_{vo}$ is increased by $\Delta S$ and the vacuum immediately before the completion of injection will coincide with the reference vacuum $H_o$.

Figure 5:
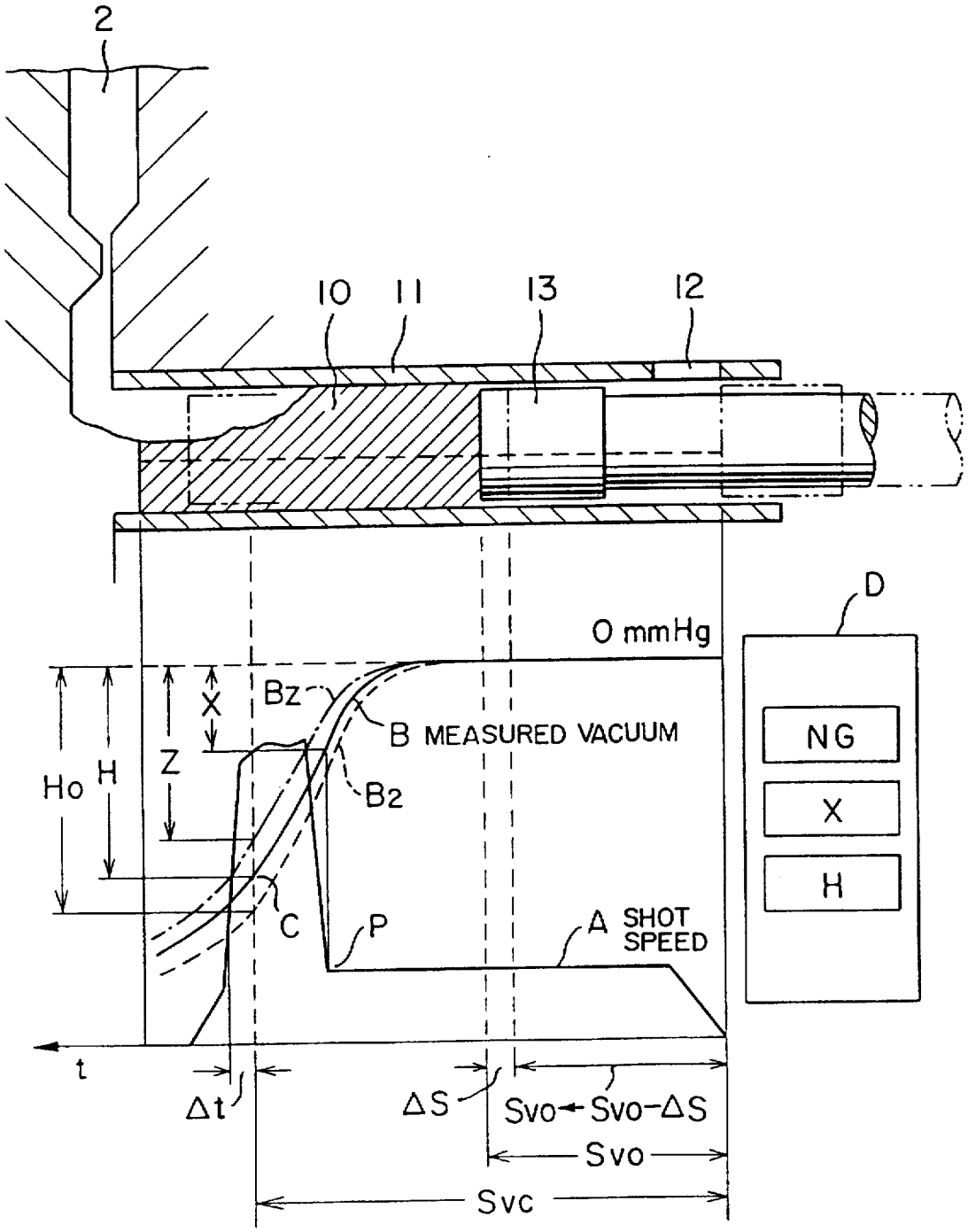
FIG. 5 is a diagrammatic view showing the display of the monitor displaying a vacuum variation curve and an injection speed curve during an injection cycle under a condition where vacuum is lower than the reference vacuum.

When the measured vacuum H is lower than the reference vacuum $H_o$ as indicated by the curve B in FIG. 5, i.e., when the decision in step S7 is negative, a correction is made to the first stroke $S_{vo}$ to advance the time to open the vacuum valve 19 in the next injection cycle. In step S9, the measured vacuum H taken at the time the injection plunger 13 has reached the second position after moving through the second stroke $S_{vc}$, is compared with a predetermined lower control limit Z taking into consideration the specifications of the die-casting machine and die-casting conditions. If the measured vacuum H is lower than the lower control limit Z, it is decided, for example, that the filter 8 is blinded and an alarm signal is proved to the alarm device 30 and the CRT 29 in step S10 and a signal to stop the die-casting machine is provided in step S11.

When the measured vacuum H is not lower than the lower control limit Z and lower than the lower limit vacuum $H-\alpha$, i.e., when the decision in step S12 is affirmative, the correction $\Delta S$ is subtracted from the first stroke $S_{vo}$ in step S13 to advance the time to open the vacuum valve 19 for the next injection cycle. The first stroke $S_{vo}$, in which the injection plunger 13 advances to reach the first position, is corrected on the basis of the stored data representing the variation of vacuum with time as indicated by the curve B. The difference between the vacuum H taken when the injection plunger 13 moved through the second stroke $S_{vc}$ to the second position and the reference vacuum $H_o$ is converted into a corresponding time difference $\Delta t$. The time difference $\Delta t$ is converted to a correction $\Delta S$. The first stroke $S_{vo}$ of the injection plunger 13 is reduced by the correction $\Delta S$ to determine a corrected first stroke for the next injection cycle. Then, it is expected that vacuum varies with time along a curve $B_2$ and that the vacuum H immediately before the completion of injection coincides with the reference vacuum $H_o$.

The first stroke $S_{vo}$ must be greater than a fixed value E relating to the position of a sprue 12. In step S14, the corrected first stroke $S_{vo}$ is compared with the fixed value E. If the corrected first stroke $S_o$ is smaller than the fixed value E, the alarm device 30 generates an alarm in step S15.

If the injection cycle is repeated without changing the initial set time to open the vacuum valve 19 notwithstanding that the vacuum measured by the vacuum sensor 40 is excessively high due to some cause, the cavity 2 is evacuated excessively rapidly. Thus, it is possible that gases are involved in the molten metal. Therefore, the time to open the vacuum valve 19 is delayed by increasing the first stroke by which the injection plunger 13 advances to reach the first position at which to open the vacuum valve 19 by the predetermined correction. Thus, the causes that form blowholes in the casting can be eliminated.

If the measured vacuum is excessively low due to blinding of the filter 8 or the like, the first stroke through which the injection plunger 13 advances to the first position, at which the vacuum valve 19 opens is reduced to advance the time the vacuum valve 19 opens. Consequently, the degassing of the cavity 2 is started earlier so that vacuum in the cavity may vary with time in an expected mode.

Since the cavity 2 is degassed through the chilling vent 20, the vacuum valve 19 need not be forcibly closed upon the completion of the injection of the molten metal. Therefore, errors attributable to the variation of the time to close the vacuum valve 19 are eliminated and the accuracy of the control operation is enhanced.

The curve indicating the variation of vacuum with time as shown in FIG. 5 is displayed together with other data on the CRT 29 during the injection cycle. In FIG. 5, a curve A indicates the variation of the shot speed of the injection plunger 13 with time, and a curve $B_c$ indicates a control limit for vacuum. When the vacuum H, at the time immediately before the completion of injection, is lower than the lower control limit Z, the die-casting machine is stopped. The variation of vacuum can be visually realized in a real-time mode from the curve B indicating the variation of the measured vacuum with time and the curve $B_1$ or $B_2$ indicating the expected variation of vacuum with time.

The central processing unit 25 processes the output pulse signal of the position sensor 22 to determine a speed change point P on the injection speed curve A where the shot speed increases sharply. The central processing unit 25 calculates a vacuum X at the speed change point P. If the vacuum X is excessively high, it is possible that the molten metal rushes into the cavity 2 to clog the vacuum valve 19. Therefore, an alarm is generated when the vacuum X is higher than the measured vacuum H at a time point C when the vacuum valve 19 is closed. Parameters necessary for monitoring the injection cycle including the vacuum X at the time when the injection speed increases sharply and the measured vacuum H when the vacuum valve 19 is closed, are displayed on the CRT 29 The curves B and $B_2$ indicating the variation of vacuum with time and the shot speed curve A shown in FIG. 5, by way of example are also displayed on the CRT 29. When the measured vacuum H is lower than the lower control limit Z, a message "NG" signifying unsuccessful vacuum die-casting.

As is apparent from the foregoing description, according to the present invention, the position of the shot plunger at which to open the vacuum valve to start degassing the cavity for the next injection cycle is determined. This determination is made according to the difference between the measured vacuum at the time immediately before the completion of injection and the reference vacuum so that the actual vacuum at the time immediately before the completion of injection may be within the allowable range. Accordingly, the formation of blowholes due to the involvement of gasses in the molten metal can be prevented and the quality of castings can be stabilized.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. A vacuum die-casting machine including:

a vacuum control system;

a die having a cavity and vacuum passageway formed therein, said vacuum passageway extending downstream from said cavity;

a vacuum system connected to said cavity;

a vacuum valve for connecting the vacuum system to and disconnecting the same from the cavity;

a vacuum device for evacuating the cavity through the vacuum system;

an injection plunger for injecting a molten metal into the cavity; said vacuum control system comprising:

a vacuum sensor connected to a port opening in said cavity upstream of said vacuum passageway for directly measuring vacuum in said cavity;

position detecting means for detecting the position of the injection plunger;

data storage means for storing data on vacuum taken at a predetermined period after the start of an injection cycle;

vacuum comparing means for comparing a vacuum measured by said vacuum sensor immediately before the completion of injection of the molten metal into the cavity and a predetermined reference vacuum; and vacuum valve opening position correcting means for correcting a first position at which to open the vacuum valve so that the first position is shifted by a predetermined distance toward the die when the measured vacuum is higher than the reference vacuum and so that the first position is shifted by a predetermined distance away from the die when the measured vacuum is lower than the reference vacuum.

2. The vacuum die-casting machine, according to claim 1, further comprising:

air vent means for introducing only gases from the cavity into the vacuum system when the vacuum valve is opened.

3. The vacuum die-casting machine, according to claim 2, wherein the air vent means is one of a chilling vent for passing only gases and having a corrugated degassing passage that solidifies the head of a molten metal so that the molten metal is unable to flow into the vacuum system and a shutoff valve that passes only gasses by using the inertia of the molten metal injected into the cavity.

4. The vacuum-die casting machine according to claim 3, further comprising a check valve connected to said port opening in parallel to the vacuum sensor to protect the vacuum sensor.

5. The vacuum die-casting machine, according to claim 1, further comprising:

an alarm signal generating means for generating an alarm signal or a die-casting machine stopping signal when the measured vacuum is lower than a predetermined limit vacuum, and an alarm device that generates an alarm upon the reception of an alarm signal.

6. The vacuum die-casting machine, according to claim 1, further comprising:

a data processing means for processing the data on vacuum stored in the storage means and data provided by the position detecting means to calculate a variation of vacuum with time and parameters indicating a speed of the injection plunger and the condition of the injection cycle; and a monitor for displaying a vacuum variation curve indicating the variation of vacuum with time representing the output of the data processing means, an injection speed curve indicating the variation of the speed of the injection plunger with time, and the parameters.

7. The vacuum-die casting machine according to claim 1, further comprising:

a vacuum line connecting said cavity to said vacuum device;

a filter provided in said vacuum line between said die and said vacuum device, said vacuum valve being provided in said vacuum line between said filter and said vacuum device.

* * * * *